US006131754A

United States Patent [19]

Smelko

[11] Patent Number: 6,131,754

[45] Date of Patent: Oct. 17, 2000

[54] SYNTHETIC TWO-PIECE INDUCTION SEAL

[75] Inventor: Joseph Smelko, Aurora, Canada

[73] Assignee: Illinois Tool Works Inc.

[21] Appl. No.: 09/212,323

[22] Filed: Dec. 15, 1998

[51] Int. Cl.[7] ..... B65D 53/04

[52] U.S. Cl. ..... 215/232; 215/347; 215/348; 215/349; 428/35.9; 428/36.5; 428/349; 428/516; 428/519; 428/458; 428/462; 428/484; 428/483

[58] Field of Search ..... 215/232, 348, 215/347, 349; 428/35.9, 36.5, 35.7, 349, 516, 519, 458, 461, 462, 484, 483

[56] References Cited

U.S. PATENT DOCUMENTS

| | | | |
|---|---|---|---|
| 4,666,052 | 5/1987 | Ou-Yang | 215/347 |
| 4,778,698 | 10/1988 | Ou-Yang | 215/347 X |
| 4,818,577 | 4/1989 | Ou-Yang | 215/347 X |
| 4,917,949 | 4/1990 | Yousif | 215/232 X |
| 4,935,273 | 6/1990 | Ou-Yang | 215/347 X |
| 5,057,365 | 10/1991 | Finkelstein et al. | 428/349 X |
| 5,381,913 | 1/1995 | Peeters | 215/347 X |
| 5,637,396 | 6/1997 | Sato et al. | 428/349 |
| 5,669,521 | 9/1997 | Wiening et al. | 215/232 |
| 5,712,042 | 1/1998 | Cain | 428/458 |
| 5,871,112 | 2/1999 | Giles et al. | 215/347 |
| 5,915,577 | 6/1999 | Levine | 215/232 |

FOREIGN PATENT DOCUMENTS

| | | | |
|---|---|---|---|
| 4-31253 | 2/1992 | Japan | 215/347 |

*Primary Examiner*—Nathan J. Newhouse
*Attorney, Agent, or Firm*—Dechert

[57] ABSTRACT

The present invention comprises a two-piece induction seal for use in creating clean, safe, and secure inner seals on containers, comprising layers of synthetic foam, absorbing synthetic polymer, an induction membrane and a heat-sensitive seal.

16 Claims, 2 Drawing Sheets

SYNTHETIC TWO-PIECE INDUCTION SEAL

FIELD OF THE INVENTION

The present invention relates to a two-piece induction seal for use in creating clean, safe, and secure inner seals on containers.

A variety of two-piece induction seals have been developed. These seals have application in the closure industry. The seal generally comprises a compressing agent (e.g., pulpboard) and a induction membrane layer (e.g., foil), with a wax layer between them to keep the them in place during processing. The membrane layer farther has an adhesive layer on its bottom surface which is generally a heat-activated adhesive layer. During bottle operations and the like, the seal is placed between the rim or other opening of the filled container and the cap. When energy is applied, the induction membrane layer becomes heated, thereby melting the wax and activating the adhesive. The result is the conversion of the one-piece unit into two pieces, with the adhesive layer bonding the membrane layer to the rim, and the melted wax being absorbed by the compressing agent. The compressing agent generally remains lodged in the inner portion of the cap or other closure device.

In common application, the compressing agent is a pulpboard material. This organic material is suitable for absorbing the melted wax. However, this system presents numerous disadvantages. The pulpboard becomes a source of paper dust which can contaminate the contents of the container. The wax-filled pulpboard can also serve as a growth medium for bacteria and other biological contaminants. Additionally, the pulpboard is moisture sensitive and can become distorted and altered by fluctuations in humidity levels.

Alternative seal structures have been developed to attempt to overcome these disadvantages. In one such alternative, the compressing agent is made of a synthetic foam material which is initially bound to a foil layer by a starch layer. Application of energy heats and transforms the starch layer, breaking the bond between the foam and the foil. The starch residue remaining on the synthetic foam can continue to serve as a bacterial growth medium.

In another alternative, the foil layer is covered with a paper layer. A wax layer initially binds the compressing agent to the paper layer of the foil. When energy is applied to the unit, the wax melts and is absorbed by the paper on the foil layer, rather than being absorbed into the synthetic foam compressing agent. Eventually, this can cause the paper layer to seal to the synthetic foam. This alternative does not solve the traditional problems of contamination, because the paper layer on the foil can continue to serve as a biological growth medium. In addition, the paper layer can present structural issues by delaminating from the foil layer and by expanding and contracting due to changes in humidity.

In still another alternative, the wax or starch layer is replaced by a pressure-sensitive adhesive. This adhesive effectively binds the compressing agent, be it pulpboard or synthetic foam, to the foil layer. The process of opening the cap imparts a shearing force which breaks that bond allowing the container to be opened. A principle disadvantage of this device is that the adhesive layer which is present on the surface of the compressing agent remains tacky. As a result, materials, such as pills or other contents of the container, dirt, and other debris, can become affixed to the inner surface of the cap.

Unipac Corporation has developed a two-piece induction seal which uses as the compressing agent a synthetic foam material with a synthetic polymer underlayer made of TYVEK® from DuPont. This seal has been found to solve some of the problems described above, but the synthetic polymer does not present a uniform absorbing surface. As a result, wax residues remain on the surface of the TYVEK® layer after induction sealing causing variable behaviour. In some instances the TYVEK® layer melts, creating difficulty in opening the container.

The present invention solves these problems in an efficient and cost-effective manner. Through the use of a compressing agent comprising a synthetic foam base and a wax-absorbing synthetic polymer, the resulting cap inner seal presents a clean, safe and structurally sound product. The microporous structure of the synthetic polymer substantially completely absorbs the wax and the synthetic structure of the polymer and the support foam do not create debris which could otherwise contaminate the contents of the container.

SUMMARY OF THE INVENTION

The present invention has a two-piece induction seal having (i) a compressing agent comprising an upper layer comprising a synthetic foam and a lower layer comprising a wax-absorbing synthetic material, (ii) wax, and (iii) an inductive innerseal membrane with a lower adhesive layer which membrane is detachably bound to the compressing agent by means of the intervening wax layer; wherein the wax-absorbent synthetic material is suitable for absorbing substantially all of the wax when the wax is in liquid form. Preferably, the wax-absorbing synthetic polymer is a microporous high density polyethylene (HDPE). The invention further includes containers which have such two-piece induction seals.

DETAILED DESCRIPTION OF THE INVENTION

Figure 1:
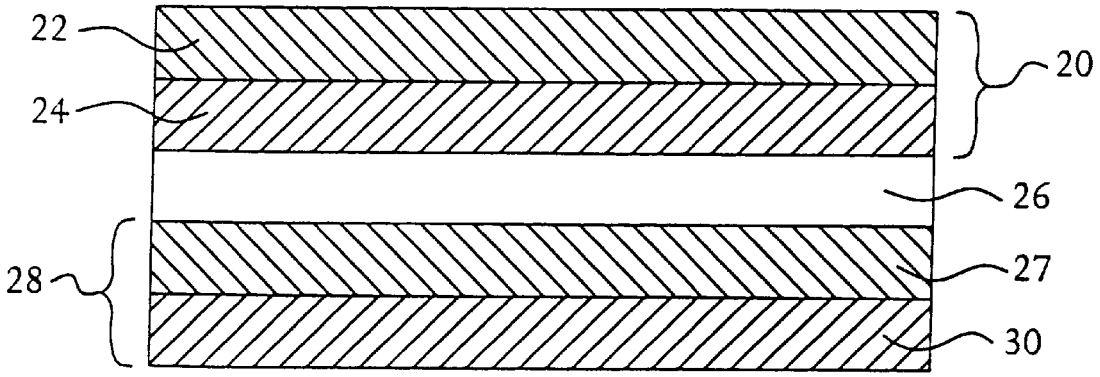
FIG. 1 is a schematic cross-sectional view of a two-piece induction seal in accordance with one preferred embodiment of the present invention.
Figure 2:
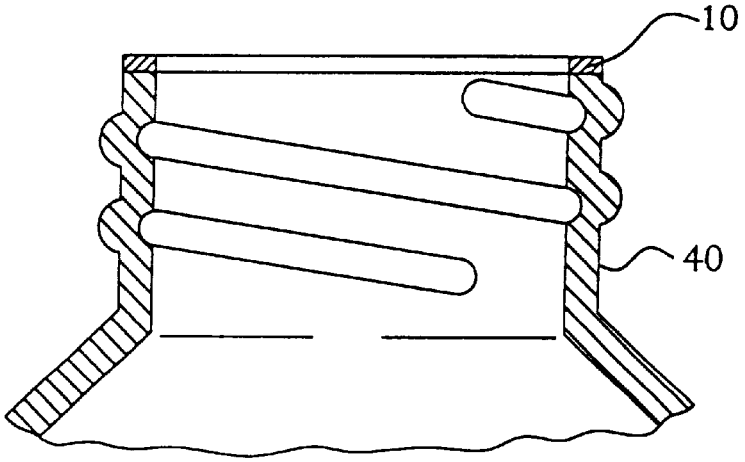
FIG. 2 is a schematic cross-sectional view of the rim or opening of a container to be sealed in combination with a two-piece induction seal in accordance with one preferred embodiment of the present invention.

FIG. 1 schematically represents, in cross-section, one embodiment of the two-piece induction seal 10 of the present invention. The seal 10 comprises a compressing agent 20, which is formed of an upper layer of synthetic foam 22 and a lower layer of synthetic polymer 24, a wax layer 26 and an inductive membrane layer 28 with a lower adhesive layer 30. FIG. 2 schematically represents a cross-section of the rim or opening 40 of a container to be sealed in combination with seal 10.

The synthetic foam layer 22 of the compressing agent 20 may be formed of any suitable material. Preferably, the foam layer 22 is formed of a material with a suitable compression factor comparable to pulpboards of the type traditionally used in induction seals. Examples of such materials are coextruded low density polyethylene (LDPE), low density polyethylene (LDPE), polypropylene (PP) and polystyrene (PS); preferably polystyrene (PS). The dimensions of the compressing agent 20 as a whole and the foam layer 22 in particular will vary according to the application and the size of the opening of the container and size and construction of the closure being used. These dimensions may be readily determined by one skilled in the art.

The synthetic polymer 24 used as the underlayer of the compressing agent 20 is preferably formed of a material comprising a microporous high density polyethylene (HDPE). These microporous HDPE materials exhibit high absorbency levels; a critical factor in the present invention. A preferred microporous HDPE is TESLIN® HDPE from PPG Industries, Inc. This material has 60% voids of a microporous nature. The material selected for use as the synthetic polymer layer 24 should have a sufficient absorbency level and suitable pore volume and structure to absorb substantially all of the wax used in the seal. Given these parameters, selection of suitable materials and determination of appropriate dimensions of the synthetic polymer layer 24 is within the ability of one skilled in the art.

Together, the synthetic foam layer and the synthetic polymer layer form the compressing agent. This compressing agent forms an atmospheric barrier which retards the migration of gases and moisture at least from outside to inside a sealed container, which gases and moisture may be harmful to the contents of the sealed container. Further, the compressing agent of the present invention is a stable material which does not chemically or structurally breakdown during the normal lifespan of the containers on which it is used. The substantially complete absorption of the wax comprising the wax layer by the polymer layer of the compressing agent avoids the variable behavior associated with TYVEK® which may render opening of the container difficult. As a result, the invention provides a clean and safe material which does not contaminate the container or its contents.

The induction seal 10 comprises a wax layer 26 which serves to bind the compressing agent 20 to the membrane layer 28. The wax layer 26 may comprise any suitable wax material which will melt within the temperature range to which the induction seal 10 is to be subjected. In general, the application of energy to the induction seal 10 within the container heats the induction membrane layer 28 to a temperature in the range from about 500 to about 700° F.; preferably about 600 to about 650° F. The wax layer 26 should be comprised of a material with a melting point less than or equal to the highest sustained temperature of the induction membrane 28 when that membrane is subjected to an energy source during the sealing process. In addition, the volume or thickness of the wax layer 26 should be selected such that substantially all of the wax will melt during the manufacturing process. Preferably, the wax layer 26 has a thickness of 0.5 to 0.7 mm; more preferably 0.5 to 0.6 mm. For example, the wax layer may comprise a blend of parafin and microcrystalline waxes. More particularly, the wax layer may comprise a blend of parafin wax and microcrystalline wax wherein the proportion of microcrystalline wax used in the wax layer is adjusted to provide the wax layer with the desired porosity. Alternatively, the wax layer may comprise microcrystalline wax modified with other polymeric additives to enhance its bonding properties. For instance, the wax layer may comprise microcrystalline wax modified with at least one of ethylene vinyl acetate and polyisobutylene. Given these parameters, selection of suitable materials and determination of appropriate dimensions of the wax layer 26 is within the ability of one skilled in art.

The induction membrane layer 28 forms a seal over the rim or opening 40 of the container and comprises a material which will become heated by induction when exposed to an external energy source. The membrane layer 28 further comprises an adhesive layer 30 on its bottom surface which affixes the membrane layer 28 to the rim or opening 40 of the container. In a preferred embodiment of the invention, the membrane layer 28 is comprised of a metallic foil 27, preferably aluminum foil. In one embodiment, the membrane layer 28 comprises aluminum foil with a thickness of 1 to 1.5 mm. The thickness of the membrane layer 28 for a given application may be determined by one skilled in the art based on the characteristics of the material used and the size and other characteristics of the opening and container being sealed.

The adhesive layer 30 affixes the induction membrane layer 28 to the rim or opening 40 of the container. The adhesive layer 30 is applied to the surface of the membrane layer 28 opposite that which contacts the wax layer 26; as referred to herein as the bottom surface of the membrane layer 28. In a preferred embodiment of the invention, the adhesive layer 30 is comprised of a heat-activated polymer, such that the heat of induction generated during the manufacturing process is sufficient to activate the adhesive and to affix the membrane layer 28 to the rim or opening 40. Suitable adhesives for use according to the invention include, but are not limited to, polyethylene, polypropylene, polyethylene terephthalate, ethylene vinyl acetate and polystyrene.

The elements of the induction seal of the present invention are assembled to form a multilayer composite from top (cap end) to bottom (rim end) comprising, as described above, the compressing agent, the wax layer and the induction membrane layer with adhesive layer. By suitable means well known in the art, a piece of this multilayer composite induction seal is placed above the opening of a filled container, which is then generally covered with the cap or other closure for the container. The filled, capped container is then exposed to an external energy source. The energy is absorbed by the induction membrane layer which becomes heated, thereby melting the wax layer and activating (or, at least, not deactivating) the adhesive layer. The induction membrane layer becomes affixed to the rim or opening of the container, while the liquid wax is substantially entirely absorbed by the wax-absorbing synthetic polymer layer of the compressing agent. This manufacturing process is carried out by conventional means using techniques and equipment readily available in the industry.

More specifically in a preferred embodiment of the invention, during the manufacturing process, the external energy is absorbed by the aluminum foil induction membrane layer which becomes heated, thereby melting the wax layer and activating the heat-activated adhesive layer. The aluminum foil layer becomes affixed to the rim of the container, while the liquid wax is substantially entirely absorbed by the TESLIN microporous HDPE layer of the compressing agent.

Figure 3:
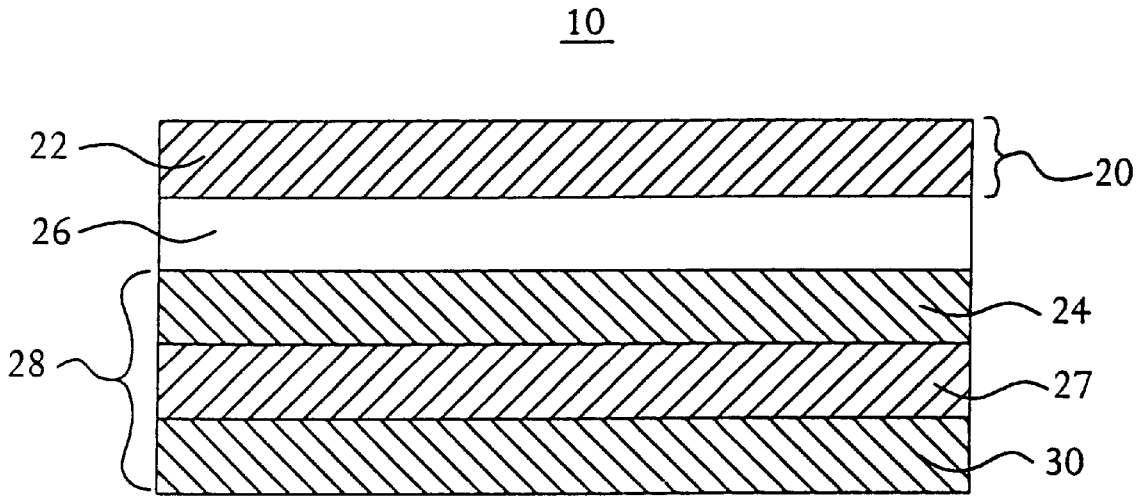
FIG. 3 is a schematic cross-sectional view of a two-piece induction seal in accordance with another preferred embodiment of the present invention.

FIG. 3 illustrates an alternative embodiment of the invention. Referring to the elements described above, the synthetic polymer layer 24 forms the upper surface of the induction membrane layer 28, rather than the lower layer of the compressing agent 20. The compressing agent 20 comprises a synthetic foam layer 22. When the seal is subjected to an external energy source and the wax is melted, the liquid wax is absorbed by the synthetic polymer layer of the induction membrane. This similarly removes substantially all of the wax layer material as a possible growth medium for bacteria and other organisms. To the extent that the membrane layer is ultimately pealed off the container rim and discarded during the opening process, this embodiment of the invention contemplates complete elimination of the wax-containing synthetic polymer.

While this invention has been described with an emphasis upon a preferred embodiment, it will be obvious to those of ordinary skill in the art that variations in the preferred composition and method may be used and that it is intended that the invention may be practiced otherwise than as specifically described herein. Accordingly, this invention includes all modifications encompassed within the spirit and scope of the invention as defined by the following claims.

What is claimed is:

1. A two-piece induction seal comprising (i) a compressing agent comprising an upper layer comprising a synthetic foam and a lower layer comprising a wax-absorbing synthetic material, (ii) a wax layer, and (iii) an inductive innerseal membrane with a lower adhesive layer which membrane is detachably bound to said compressing agent by means of said wax; wherein said wax-absorbent synthetic material is suitable for absorbing substantially all of said wax layer when said wax layer is in liquid form.

2. The seal of claim 1 wherein said wax-absorbing synthetic material comprises a microporous high density polyethylene.

3. The seal of claim 1 wherein said synthetic foam comprises at least one of coextruded low density polyethylene, low density polyethylene, polypropylene and polystyrene.

4. The seal of claim 1 wherein the synthetic foam comprises polystyrene.

5. The seal of claim 1 wherein the wax layer comprises a blend of a parafin wax and a microcrystalline wax.

6. The seal of claim 1, wherein the wax layer has a thickness of 0.5 to 0.7 mm.

7. The seal of claim 1 wherein said membrane comprises aluminum foil.

8. The seal of claim 7 wherein the membrane has a thickness of 1.0 to 1.5 mm.

9. The seal of claim 1 wherein said adhesive layer comprises a heat-activated polymer.

10. The seal of claim 9, wherein the heat-activated polymer comprises at least one of polyethylene, polypropylene, polyethylene terephthalate, ethylene vinyl acetate and polystyrene.

11. The seal of claim 1 wherein the wax layer comprises a microcrystalline wax.

12. The seal of claim 11, wherein the wax layer further comprises an additive which enhances the bonding properties of the wax layer.

13. The seal of claim 12, wherein the additive comprises at least one of ethylene vinyl acetate and polyisobutylene.

14. A container comprising a rim and a cap seated on said rim and comprising a two-piece induction seal situated between said cap and said rim, said seal comprising (i) a compressing agent comprising an upper layer comprising a synthetic foam and a lower layer comprising a wax-absorbing synthetic material, (ii) wax, and (iii) an inductive innerseal membrane with a lower adhesive layer which membrane is detachably bound to said compressing agent by means of said wax; wherein said wax-absorbent synthetic material is suitable for absorbing substantially all of said wax when said wax is in liquid form.

15. A container sealed by means of a two-piece induction seal, said seal comprising (i) a compressing agent comprising an upper layer comprising a synthetic foam and a lower layer comprising a wax-absorbing synthetic material, (ii) wax, and (iii) an inductive innerseal membrane with a lower adhesive layer which membrane is detachably bound to said compressing agent by means of said wax; wherein energy applied to said seal causes said membrane to become heated, and causes said wax to melt and to be substantially entirely absorbed into said wax-absorbing synthetic material.

16. A two-piece induction seal comprising (i) a compressing agent comprising an upper layer comprising a synthetic foam and a lower layer comprising a microporous high density polyethylene, (ii) wax, and (iii) an aluminum foil membrane with a lower heatactivated adhesive layer which membrane is detachably bound to said compressing agent by means of said wax; wherein said high density polyethylene is suitable for absorbing substantially all of said wax when said wax is in liquid form.

* * * * *